US009510648B2

(12) United States Patent
Moreno-Stolz

(10) Patent No.: US 9,510,648 B2
(45) Date of Patent: Dec. 6, 2016

(54) LACE JOINING AND EXCHANGING SYSTEM

(75) Inventor: Alexander Moreno-Stolz, Mutterstadt (DE)

(73) Assignee: Sigrun Schneider, Wassertruedingen (DE)

( * ) Notice: Subject to any disclaimer, the term of this patent is extended or adjusted under 35 U.S.C. 154(b) by 618 days.

(21) Appl. No.: 13/640,676

(22) PCT Filed: Aug. 31, 2010

(86) PCT No.: PCT/EP2010/005347
§ 371 (c)(1),
(2), (4) Date: Nov. 26, 2012

(87) PCT Pub. No.: WO2011/127949
PCT Pub. Date: Oct. 20, 2011

(65) Prior Publication Data

US 2013/0097829 A1 Apr. 25, 2013

(30) Foreign Application Priority Data

Apr. 12, 2010 (DE) ..... 10 2010 003 878

(51) Int. Cl.
*A44B 1/04* (2006.01)
*H01Q 1/27* (2006.01)
(Continued)

(52) U.S. Cl.
CPC . *A43C 9/00* (2013.01); *A43C 9/02* (2013.01); *A43C 9/06* (2013.01); *H01Q 1/273* (2013.01); *Y10T 24/3732* (2015.01); *Y10T 24/3789* (2015.01)

(58) Field of Classification Search
CPC ... Y10T 24/31; Y10T 24/312; Y10T 24/314; Y10T 24/398; A63B 55/007; F16G 11/00; G09F 3/14; A43C 11/08; A43C 9/06
See application file for complete search history.

(56) References Cited

U.S. PATENT DOCUMENTS 1,871,370 A 8/1932 Jacques
2,267,802 A 12/1941 Purdy
(Continued)

FOREIGN PATENT DOCUMENTS

DE 200 20 096 U1 3/2001
DE 102005018968 A1 11/2006
(Continued)

OTHER PUBLICATIONS

International Search Report issued May 13, 2011 from International Patent Application No. PCT/EP2010/005347, filed Aug. 31, 2010.

*Primary Examiner* — Robert J Sandy
*Assistant Examiner* — Matthew Sullivan
(74) *Attorney, Agent, or Firm* — Workman Nydegger

(57) ABSTRACT

The invention relates to the joining together of laces and laces with detachable applications and, in particular, to lace systems (100) for exchanging laces, joining parts especially suitable for this purpose and the attachment of applications to such an exchangeable lace. Such a lace system allows guided laces to be exchanged and comprises a device (110) with a lace guide (112), wherein the device is at least part of a shoe (182), a garment (184), a rucksack (186) or a bag (188). Furthermore, such a lace system comprises a first lace (120), which is guided in the lace guide and has a joining part (122), and a second lace (140), which has a joining part (142), wherein the first and second laces can be joined by means of the joining parts and the joining parts have a diameter that is not substantially any greater than the diameter of the first lace or the lace guide, such that the laces joined by means of the joining parts can be pulled through the lace guide together with the joined joining parts.

10 Claims, 7 Drawing Sheets

(51) Int. Cl.

| | |
|---|---|
| ***A43C 9/00*** | (2006.01) |
| ***A43C 9/02*** | (2006.01) |
| ***A43C 9/06*** | (2006.01) |

(56) References Cited

U.S. PATENT DOCUMENTS

| | | | | |
|---|---|---|---|---|
| 2,451,247 | A * | 10/1948 | Sims | 24/713.1 |
| 2,861,314 | A * | 11/1958 | Applebaum | 24/712.2 |
| 3,243,550 | A | 3/1966 | Hollins | |
| 3,559,251 | A | 2/1971 | Wilson | |
| 4,986,457 | A * | 1/1991 | Faris | 223/1 |
| 7,246,417 | B1 | 7/2007 | Huang | |
| 2003/0041477 | A1* | 3/2003 | Liu | 36/50.1 |
| 2005/0132546 | A1 | 6/2005 | Cheng | |
| 2008/0295305 | A1* | 12/2008 | Hsu | 24/715.6 |
| 2009/0077778 | A1 | 3/2009 | Quiroz et al. | |
| 2014/0215770 | A1* | 8/2014 | Levesque et al. | 24/303 |

FOREIGN PATENT DOCUMENTS

| | | | |
|---|---|---|---|
| EP | 0075252 | A2 | 3/1983 |
| EP | 1883078 | A1 | 1/2008 |
| GB | 569264 | | 5/1945 |
| JP | 2001321204 | A | 11/2001 |
| WO | 9702767 | | 1/1997 |

* cited by examiner

LACE JOINING AND EXCHANGING SYSTEM

BACKGROUND OF THE INVENTION

1. Field of the Invention

The invention generally relates to the joining together of laces and laces with detachable applications, and in particular to lace systems for exchanging laces, joining parts especially suited for this purpose, and the attachment of applications to such an exchangeable lace.

2. Present State of the Art

Well-known tying or pulling laces inserted in a trouser waistband or a pulling lace channel of a hood are guided through corresponding channels and are therefore essentially invisible. Such laces are for this reason often designed without any ornaments with a circular cross-section in the form of a thin rope. However, in the field of textiles, there are also known belt laces which are guided through transparent lace guides. Such belt laces are alternatively even visible for the observer when they are guided externally, for example, through loops as in a waistbelt, or through rings. It is common to all these lace guide systems that it is difficult to exchange the laces, or that they are not at all designed to be movable or exchangeable.

The above-described well-known tying laces and tying belts sometimes comprise shortening or retaining devices that are intended to permit to adjust the length of the pulling or tying lace or prevent the end sections of the lace from slipping back into the guiding channel. These shortening or retaining devices, however, are also an obstacle to the guidance of the lace through the channel and thus for an exchangeability of the lace.

SUMMARY OF THE INVENTION

In the fashion and accessory industry, there is a demand for employing pulling or tying laces as contrasting color elements in garments, shoes, bags or rucksacks. Now, the basis of the invention is the awareness that it is desirable to permit an exchangeability of the laces employed in this manner.

It is therefore the object of the present invention to permit the exchangeability of belt and tying laces for textiles, shoes, bags and rucksacks.

This object is achieved by the subject matter of independent claim 1, wherein, apart from a device with a lace guide, the device being at least a part of a shoe, a garment, a rucksack or a bag, a first lace with a joining part guided in the lace guide, and a second lace with a joining part are provided, and wherein the first and the second laces can be joined via the joining parts, and the joining parts have a diameter that is essentially not larger than the diameter of the first lace or the lace guide, such that the laces joined via the joining parts can be pulled through the lace guide together with the connected joining parts.

Advantageous embodiments of the invention are given in the sub-claims.

In one preferred embodiment, the joining parts are designed cylindrically symmetrically about a central axis of symmetry. Foldout stop devices can be provided, so that in a folded-out state, slipping back into the lace guide or the tying channel is prevented. The diameter of the joining parts must not be larger than permitted by the optionally flexible lace guide for successfully passing the joining part through the lace guide. In belt laces whose width generally nearly corresponds to the channel width predetermined by the lace guide, the joining part should have a diameter that accordingly is not larger than the width of the belt lace.

According to an aspect of the invention, a lace system with a lace with a joining part exchangeable in this manner is provided, to which an attachment device can be mounted by means of a connectable joining part.

Here, the joining part of the lace has a diameter that is essentially not larger than the diameter of the lace or the lace guide, so that the lace can be pulled through the lace guide together with the joining part and thus the exchangeability of the lace provided in the lace guide is ensured. According to an advantageous embodiment, the shape of the joining part is cylindrical.

The lace system according to the invention permits to exchange guided laces because, preferably due to an essentially cylindrical shape, the joining parts are designed such that they are easy to handle and grip and can in particular be moved through the lace guide very easily. For this, at the point of their largest cross-section, the diameter of the joining parts is adapted to the geometry of the corresponding lace guide. With a flat lace guide for belt laces, the diameter should be smaller than or at most equal to the width of the lace guide, while a maximum cylinder diameter depends on the flexibility of the lace guide.

Not only does the lace system according to the invention permit an improved exchange of optionally multicolored laces or laces having different material properties—for example, a lace of low elasticity originally fixed in a lace guide can be replaced by one of high elasticity or vice-versa—but it also permits to link an arbitrary number of laces with corresponding joining parts at both ends and to attach objects to terminal joining parts of a lace chain consisting of one or several laces. So, according to the present invention, for example an object can be provided with a corresponding joining part or attached to a guided lace at a rucksack or a bag or a hood lace via a lace with a corresponding joining part. For example, a shoe with a tying lace with joining part according to the invention can be advantageously appended to a lace according to the invention which is attached to and guided at a rucksack.

According to an aspect of the invention, the lace guided in a pulling or retaining channel comprises a suited joining part at either end. In an advantageous embodiment, the lace can be closed in itself by means of these joining parts, for example with a thread or a bayonet catch. An undesired entry of the joining parts into the guiding channel, which would affect their accessibility, can be prevented by suited activatable stop devices at the joining part. For example, foldout stop devices can be provided, so that the joining part is prevented from entering the lace guide in a state where the stop devices are activated.

According to a further aspect of the invention, a joining part is provided which can particularly advantageously be used for joining flexible textile laces, but can also establish a connection between rigid devices. The joining part comprises a fixing part for attaching the joining part to the object to be connected and a rotary cylinder with one half of a bayonet catch, the rotary cylinder being rotatably mounted on a cylindrical body that is firmly connected to the fixing part. The joining part furthermore comprises an external cylinder surrounding the rotary cylinder and being axially movable relative to the latter, and a spring disposed between the external cylinder and the fixing part and acting between them. The spring establishes the axial movability between the external cylinder and the rotary cylinder. The rotary cylinder can be brought into closing engagement with the counterpart of the bayonet catch, i. e. the other half of the bayonet catch, by axial application of a force onto the external cylinder in the direction of the fixing part against the compressive force of the spring acting between the external cylinder and the fixing part, and by subsequent rotation of the rotary cylinder about the cylinder axis to arrest the bayonet catch. Here, the external cylinder can be engaged with the rotary cylinder by suited guiding devices to transmit a rotation of the external cylinder to the rotary cylinder.

According to an advantageous embodiment, the joining part furthermore comprises a cylinder ring submerging in the fixing part and surrounding the spring and screening it partially or completely from the outside. Preferably, the diameters of the fixing part, which can also have a cylindrical design, and of the external cylinder correspond to each other, where the cylinder ring offset to the inside and screening the spring can create bicolor optics by color contrasts.

Since the bayonet catch can be arrested by pressing the external cylinder in the direction of the fixing part and thereby in the direction of the object or flexible lace attached to the fixing part, the joining part according to the invention permits an aligned placement of a matching counterpart and thereby a comfortable and fail-proof establishment of the connection between two objects or flexible laces equipped with the joining parts according to the invention. A user only has to take care to place the joining parts so that they are aligned and can then establish a reversible locking by correspondingly pressing the objects to be joined against each other with subsequent arresting rotation. Advantageously, the counterpart of the joining part which comprises the counterpart of the bayonet catch, that means the other half of the bayonet catch, is equipped with an external cylinder disposed around a cylinder with the groove or the pin of the bayonet catch. The external cylinder is engaged with the cylinder, the cylinder being firmly connected with a fixing part. The external cylinder of this additional joining part causes, when it is connected with the first joining part by aligned placement of the external cylinder onto the external cylinder of the first joining part, the axial application of force against the pressure spring action of the first joining part. According to an advantageous embodiment, the second joining part with the counterpart of the bayonet catch also comprises a spring which is attached between the fixing part and the external cylinder and acts between them, where by providing this further spring, also the external cylinder of the second joining part is axially movable relative to the cylinder.

BRIEF DESCRIPTION OF THE DRAWINGS

Further embodiments of the invention and pertaining detailed information are represented in the following drawings and will be described below.

In the drawings

DETAILED DESCRIPTION OF THE PREFERRED EMBODIMENTS

To illustrate the invention, the enclosed drawings will now be explained more in detail. The following description of the figures here starts from exemplary embodiments of the invention, however, the present invention is not restricted to the individual embodiments.

Figure 1A:
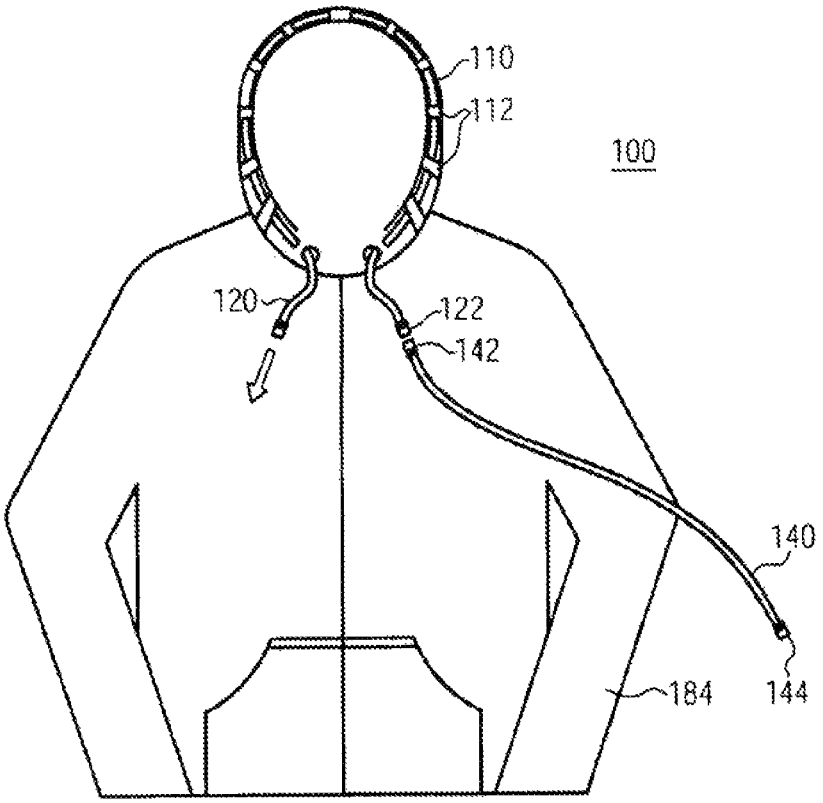
FIGS. 1A to 1D show schematic representations of the lace system according to the invention for exchanging guided laces.

FIGS. 1A to 1D show, in a schematic representation, exemplary embodiments of the lace system according to the invention which permits to exchange guided laces. FIG. 1A here illustrates a hoodie jacket as an exemplary garment 184 comprising a hood with a tying channel. Here, the hood, as a part of the hoodie jacket 184, is a textile device 110 with a lace guide 112 in the form of the hood's tying channel. In the channel 112, a first lace 120 is guided which comprises at least one joining part 122. However, according to one embodiment, the first lace 120 can also comprise a second joining part 124 at the other end of the lace 120.

The joining parts are advantageously cylindrical and have a threaded fastener or bayonet catch. According to an embodiment, the joining parts 122 and 124 can be interconnected, so that a locking of the lace 120 guided in the lace guide 112 can be established. One joining part can be provided on the lace so as to be displaceable, e. g. to cause an adjustment of the hood circumference by a correspondingly effective shortening of the lace. As an alternative, the joining parts are each fixed at an end of the lace. Fixing can be effected by clamping, gluing, knotting or attaching the joining part in corresponding recesses in the lace.

In particular, the joining parts have a diameter that is essentially not larger than the diameter of the first lace 120 or the lace guide 112, so that the joining parts can be pulled through the lace guide 112 together with the lace 120. According to an advantageous embodiment, the joining parts have an essentially cylindrical shape. One or both of the joining parts can comprise activatable stop devices, so that the joining part is prevented from entering the lace guide 112 in a state where the stop devices are activated, for example folded out. For example, a crown can be provided which can be folded out by the user and thus effectively increases the diameter of the joining part beyond the opening of the inlet of the lace guide 112, so that the joining part can no longer be pulled through corresponding loops or channels of the lace guide 112. This prevents a lace from being unintentionally guided through the lace guide in such a manner that a joining part is brought within the lace guide to a section of the lace guide that is difficult to access and this joining part is therefore no longer accessible. In this case, the lace can generally no longer be returned to the desired position, in particular if no connection with a further lace was yet established at this joining part; and the repositioning of the lace to the desired position where both end sections of the lace project from the lace guide is complicated or even impossible.

The lace 120 can be designed as a tying lace with an essentially circular cross-section, as a rope, e. g. in sports bags or rucksacks for mountaineering, or as a flat belt lace.

The lace system 100 furthermore comprises a second lace 140 with at least one joining part 142. The second lace 140 can additionally comprise a further joining part 144 at its other end. According to the invention, the first lace 120 and the second lace 140 can be joined via the joining parts 122 and 142. The at least one joining part 142 of the second lace 140 also has a diameter that is essentially not larger than the diameter of the first lace 120 or the lace guide 112, depending on whether the first lace is a belt lace and how flexible the lace guide is designed, so that the laces joined via the joining parts can be comfortably pulled through the lace guide together with the connected joining parts. According to an advantageous embodiment, the joining parts of the second lace have an essentially cylindrical shape. The second lace 140 is correspondingly also designed such that it can be guided through the lace guide like the first lace. The joining parts 122 and 142 can comprise a threaded fastener or bayonet catch. These types of locking are advantageous because the user, when joining the two joining parts in an aligned manner, will particularly easily get a feedback indicating how and whether a locking is established. Since in the preferred fields of application in the textile or accessory field, the point of establishing a corresponding connection is often not visible for the user and he rather depends on tactile feedback, a flush and aligned placing of cylindrical joining or plug parts permits particularly comfortable handling.

Figure 1B:
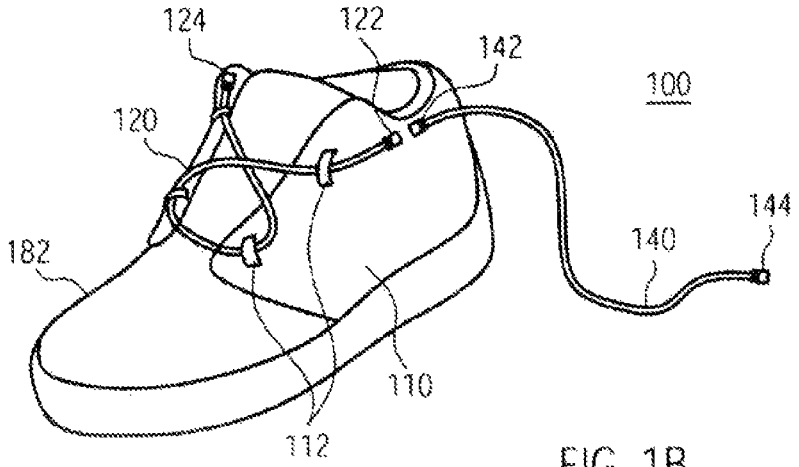

FIG. 1B shows the lace system 100 according to the invention for an example of use where the tying lace of a shoe 182 is exchanged. Here, a tying lace guide 112 is disposed in the upper region 110 of the shoe 182. The laces 120 and 140 are illustrated as thin tying laces. This second embodiment does not differ from the one illustrated in FIG. 1A as concerns the features essential to the invention.

Figure 1C:
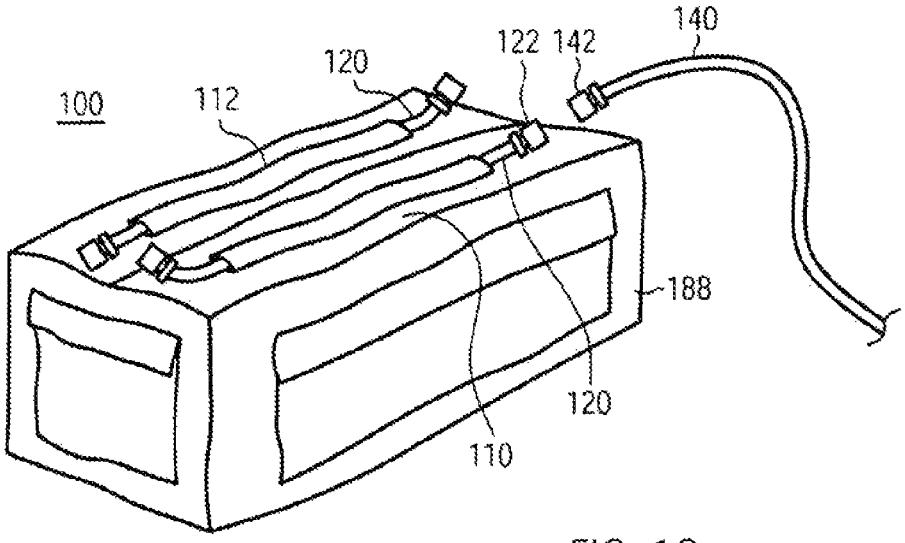
Figure 1D:
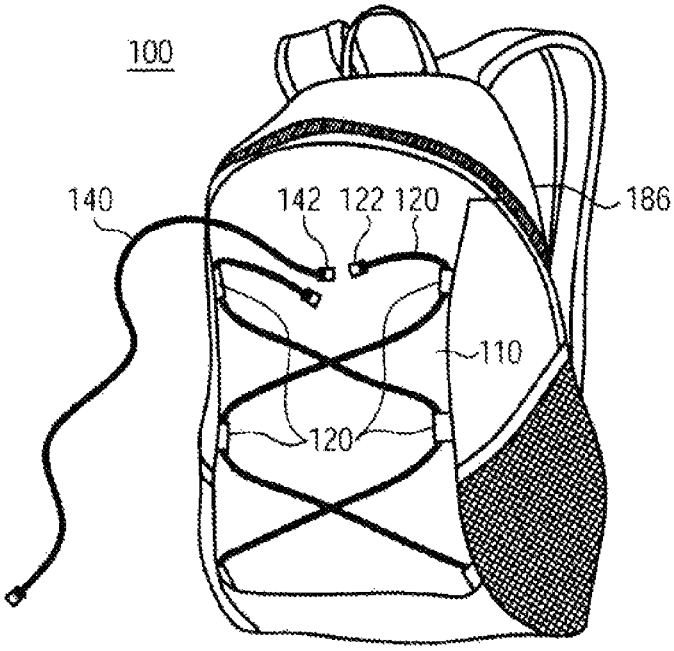

The same applies to the embodiment illustrated in FIG. 1C with respect to the application of the lace system 100 according to the invention for a sports or traveling bag 188. FIG. 1D finally illustrates, as an embodiment of the invention, the application for a rucksack 186.

Figure 2A:
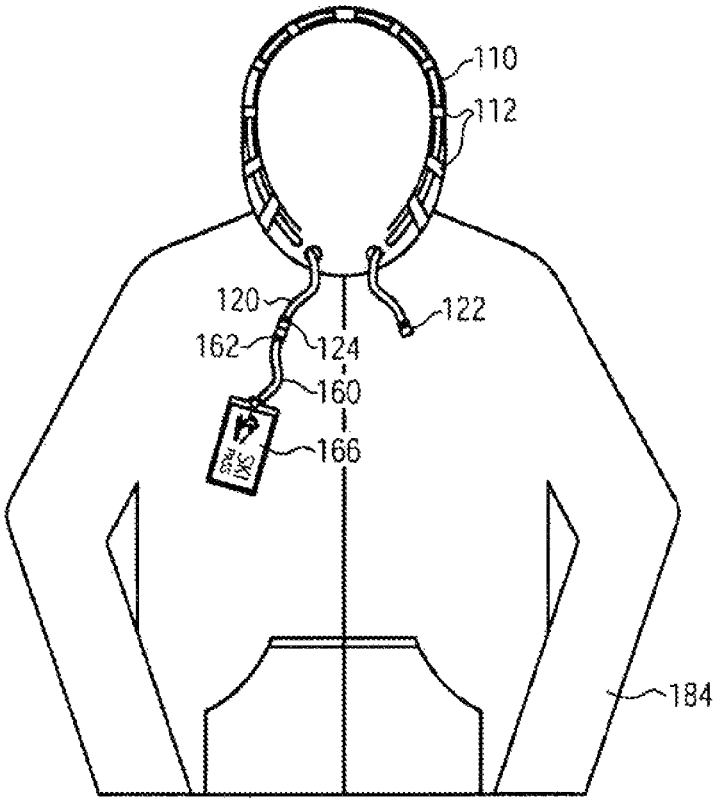
FIG. 2A shows a schematic representation of the attachment of objects to an exchangeable lace according to the invention.

FIG. 2A shows an exemplary application of the lace system with an object appended to the lace guided in the lace guide. As an exemplary object, an identification means, e. g. a skiing pass, is shown. The skiing pass or in general the object to be appended is here either directly provided with a joining part according to the invention and connected via the same, or is connected with the joining part via an intermediate lace via which then the connection with the lace guided in the lace guide can be established. As is represented, for example a tying lace in the hooded sweatshirt can be provided and designed at both ends with a plug part or a joining part according to the present invention. Here, the joining parts can be provided to be movable or variably fixable on the lace, or they can be firmly connected with the end of the lace. If an object is attached only at one of the joining parts at or near the end of the guided lace, one must prevent the lace from slipping through the guide at the other joining part by means of a stop device. For this purpose, suited stop devices are provided according to this embodiment at one or at both joining parts which can effectively increase the diameter of the joining part or can increase it by activation to prevent the entry into the guide channel.

Figure 2B:
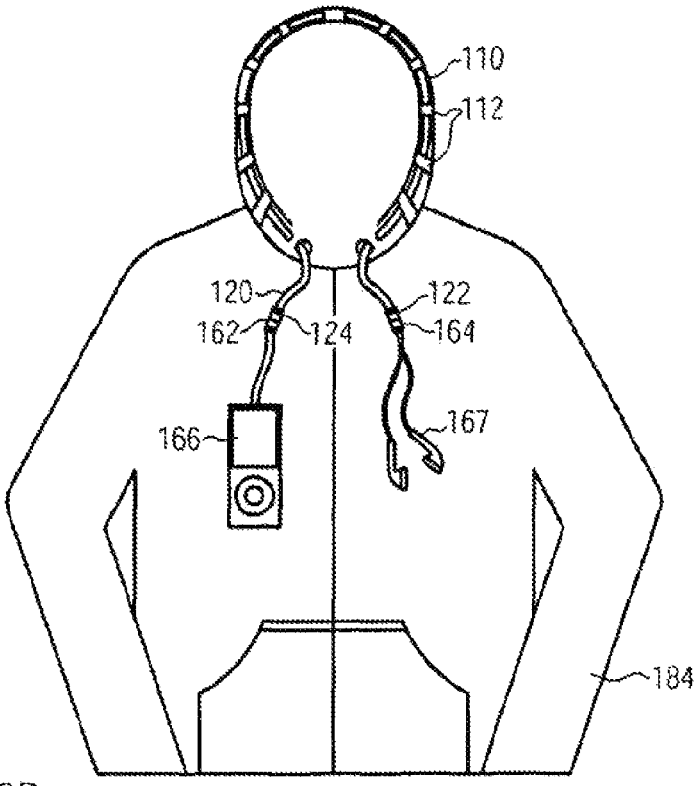
FIG. 2B shows a schematic representation of an exchangeable lace according to the invention with joining parts permitting the connection of a media player and a headset.

FIG. 2B schematically shows an embodiment where the lace system is designed not only for a mechanical connection, but also for establishing an electric connection and signal transmission. Here, the first or second lace of the lace system, as described under FIGS. 1A to 1D, is embodied with an electric connection, so that a functional connection between a media player and a headphone, for example a headset, can be established via the exchangeable lace. As is represented, a media player, for example an Apple iPod® or an Apple iPhone®, can be appended and connected on one side of the lace via the joining parts according to the invention and connected via the lace with a headset 167 appended and connected on the other side of the lace by means of a further joining part 164 allocated to the headset 167. The media player 166 can be appended to and connected with a joining part 162 directly, or by using an intermediate lace or another joining device. In general, the media player will be considerably heavier than the headset, so that according to one embodiment, either variably positionable retaining devices are attached on the lace 120 which prevent the lace from slipping due to the imbalance of the appended objects, i. e. the media player 166 and the headset 167, or above mentioned reversibly activatable stop devices are provided at the joining parts 122 and 124 to this end.

Figure 2C:
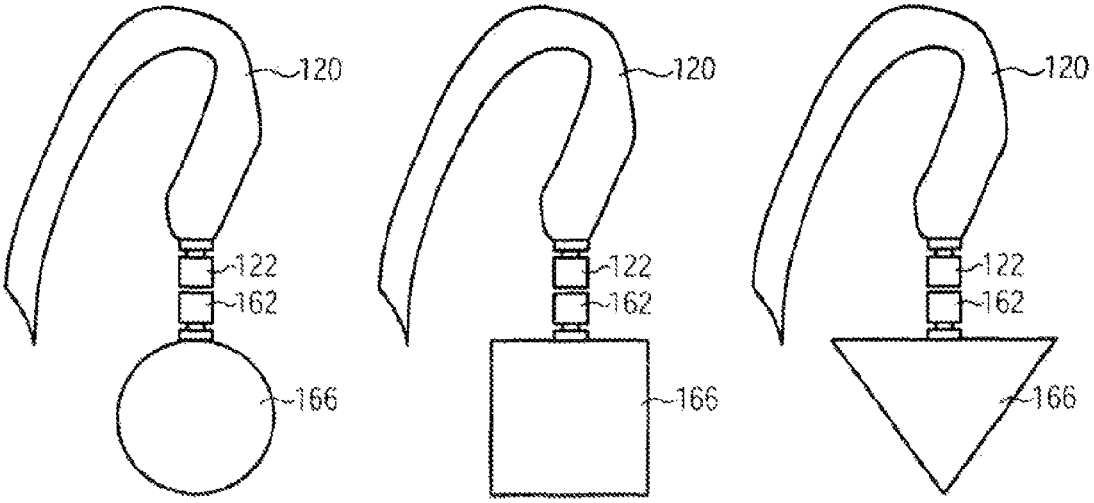
FIG. 2C shows a schematic representation concerning the provision of exchangeable application modules that can be joined to a tying lace by means of a joining part according to an advantageous embodiment of the invention.

FIG. 2C schematically illustrates the modularity of the lace system according to the invention for changing an attachment 166 at an exchangeable lace 120. Here, the system comprises parts of a shoe 182, a garment 184, a rucksack 186 or a bag 188 as a first device 110 with a lace guide 112 which can be embodied as transparent or opaque channel or by guide loops or clamps. A lace 120 guided in the lace guide 112 comprises a joining part 122. The system furthermore comprises an object 166 with a joining part 162 via which the object 166 can be connected with the lace 120 by joining the joining parts 162 and 122. Here, the joining part of the lace and the lace fulfill the requirements described above for the lace system. The present invention comprises an application concept for fashion accessories or identification means and for media players and corresponding equipment, where all these objects can be appended as attachment 166 at one end of the guided lace 120 with the joining parts 122 and 162.

According to one embodiment, the lace 120 can here comprise an antenna and the joining part 122 an antenna port.

Figure 3:
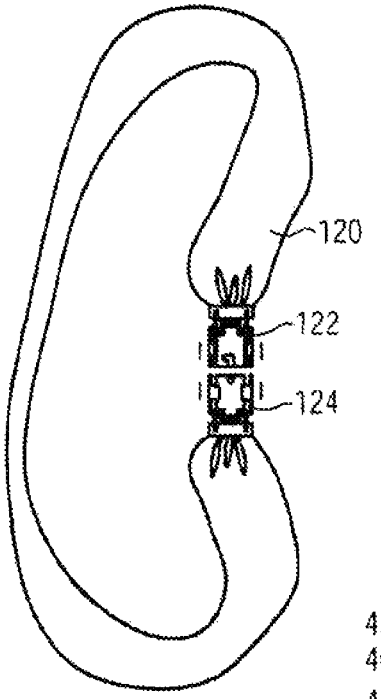
FIG. 3 shows a schematic representation of a lace with joining parts according to a preferred embodiment of the invention.

FIG. 3 illustrates that an exchange lace 120 according to the present invention can comprise joining parts 122 and 124 at both its ends which can be brought into closing engagement with each other. For this, a threaded fastener or a bayonet catch can be provided. The lace ends are clamped or glued in the representation of FIG. 3, but could also be attached by knots or hung up in alternative embodiments. A lace 120 closed as in FIG. 3 can be used, for example, as hood lace, as tying lace, as trouser waistband or waistbelt, or as carrying strap for a rucksack or a bag. In particular, such laces can be arbitrarily linked to each other with asymmetric lockings. So, it is provided in one embodiment that laces 120 of a bag or a rucksack disposed in lace guides as short carrying straps are converted to long belts by connecting them with further laces with joining parts according to the invention, so that it becomes possible, for example, to hang the bag over the shoulder of a user.

Figure 4A:
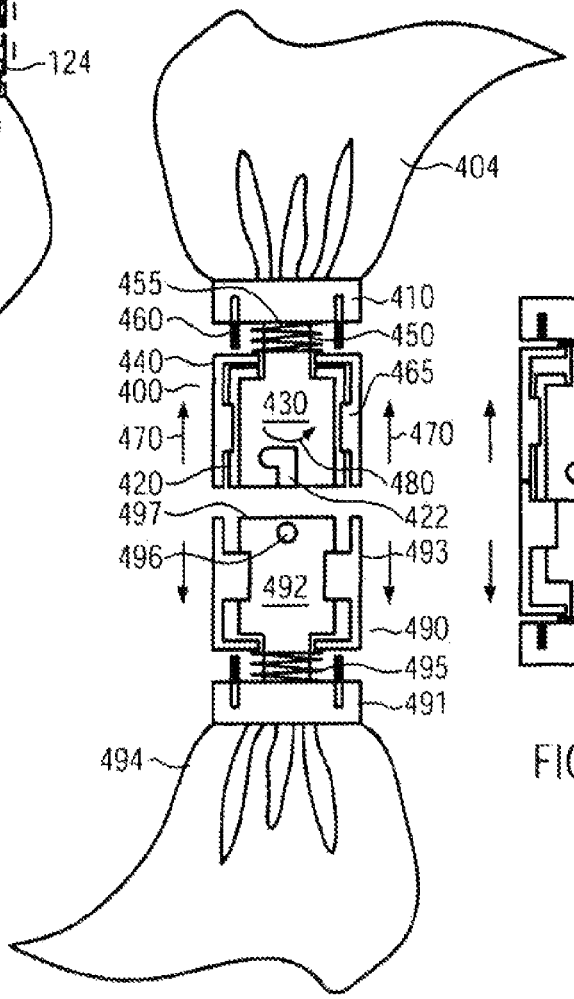
FIG. 4A shows a schematic representation of a joining system, consisting of two cylindrical joining parts according to a preferred embodiment of the invention.

FIG. 4A shows a joining part according to a preferred embodiment of the invention. This joining part 400 and the corresponding joining system of the joining parts 400 and 490 can be advantageously provided in the lace systems of FIGS. 1A to 1D, 2A to 2C and 3. The joining part 400 comprises a fixing part 410 for attaching the joining part 400 to an object or a textile piece, preferably a lace. Here, a lace 404 can be clamped or glued into the fixing part 410. Preferably, the fixing part has an essentially cylindrical design. The joining part 400 furthermore comprises a rotary cylinder 420 for a bayonet catch, this rotary cylinder being rotatably mounted on a cylindrical body 430. The cylindrical body 430 is firmly connected to the fixing part 410. An external cylinder 440 surrounds the rotary cylinder 420 and is axially movable relative to the latter. This movability is provided by a spring 450 which is disposed between the external cylinder 440 and the fixing part 410 and acts between them. Preferably, this spring 450 is designed as tension and pressure spring. Here, the tension spring property is provided for imparting the required stability to the joining system, whereas the design of the spring as pressure spring serves the arresting mechanics and furthermore reinforces the required frictional force for an unintentional release of the arrest. The rotary cylinder 420 can be brought into a closing engagement with its bayonet catch counterpart, i. e. the other half of the bayonet catch, by axial application of force on the external cylinder 440 in the direction 470 of the fixing part 410 against the compressive force of the spring 450 and by subsequent rotation 480 of the rotary cylinder 420 about its cylinder axis.

Here, the external cylinder 440 can be engaged with the rotary cylinder 420 by guide means 465, so that a rotation of the external cylinder 440 is transmitted to the rotary cylinder. According to an advantageous embodiment of the invention, the joining part furthermore comprises a cylinder ring 460 submerged in the fixing part 410 and surrounding the spring 450. The cylinder ring 460 screens the spring from the outside. The cylinder ring 460 can be firmly attached to the external cylinder or be attached with a spring at the bottom of a submerged ring in the fixing part 410 and accordingly cause a locking of the gap between the fixing part 410 and the external cylinder 440 caused by the spring. This cylinder ring 460 on the one hand acts as a screen for covering the spring mechanics, but it can also be employed for achieving a color contrast effect and esthetic symmetry. In particular, however, the cylinder ring fulfills the technical function of preventing parts of the lace guide from getting caught by the spring 450 or the edges adjoining the gap between the external cylinder 440 and the fixing part 410, in particular when the joining part is guided through the lace guide. The provision of a cylindrical fixing part 410, the external cylinder 440 and the cylinder ring 460 provides a homogenous outer cylindrical shape of the joining part and thus permits particularly comfortable handling and passing through of the joining part 400.

The illustrated cylindrical body 430 is connected with the fixing part 410 via a web 455, and the spring 450 is disposed around the web 455. In the embodiment of the rotary cylinder 420 as bayonet catch part, the rotary cylinder 420 either comprises a groove 422 or a pin or spring, respectively. The cylindrical body may in this embodiment not reach the groove 422, so that an engagement with the bayonet catch counterpart is possible. The groove 422 preferably has a rectangular design. In an advantageous embodiment, retaining means can be embodied in the end region of the groove which, by the rotation 480 of the rotary cylinder 420, is occupied by the pin of the bayonet catch, the retaining means hindering an unintentional release of the bayonet catch. For this, a constriction can be provided in front of an end position in the groove which can e. g. only be overcome by the pin by slightly bending the rotary cylinder material in the border area to the outside, which material is correspondingly embodied to be flexible to this end. As an alternative, a lining of the end position region of the groove 422 with a flexible material, e. g. rubber or plastic, can be provided. The compressive force of the spring 450 additionally leads to an amplification of the frictional force in the groove because the compressive force is perpendicular to the rotary motion required for releasing the arrest opposite to the sense of rotation 480 and thus increases static and kinetic friction in the peripheral, i. e. surrounding, groove region of the rotary cylinder 420.

In FIG. 4A, moreover a second joining part 490 is shown which forms, together with the first joining part 400, a joining system for establishing a closing, reversibly releasable connection between the two joining parts. Here, the second joining part 490 comprises the counterpart of the bayonet catch. The second joining part also comprises an external cylinder 493 with a radius corresponding to that of the external cylinder 440. The external cylinder 493 is disposed around a cylinder 492 with the counterpart consisting of a groove or pin firmly connected to the fixing part 491 of the joining part 490; the provision of a pin 496 is illustrated. When the second joining part 490 is connected with the first joining part 400, the axial application of force on the external cylinder 440 of the first joining part 400 is caused by pressing the external cylinder 493 onto the external cylinder 440 against the compressive force of the spring 450. This means, the external cylinder 493 is placed against the external cylinder 440 in a flush and aligned manner. By this, the external cylinder 440 is displaced relative to the rotary cylinder 420 in the direction of the fixing part 410, while the spring 450 is compressed and, as a consequence, the pin 496 and the groove 422 can be moved towards each other. For this, the cylinder 492 can be inserted into the rotary cylinder 420. Preferably, the pin 496 is slightly spaced apart from the adjacent cylinder edge 497 for this to permit the initial establishment of an engagement between the cylinders 492 and 420 without already previously requiring a complete alignment of the groove 422 and the pin 496. After the two cylinders have entered each other, a corresponding alignment must then be performed to achieve further insertion against the compressive force of the spring 450 and finally permit a rotation 480 for establishing the arrest.

According to an alternative embodiment, instead of the embodiment of the rotary cylinder 420 and the cylinder 492 as bayonet catch, a threaded fastener can be provided. The bayonet catch is more comfortable to handle, whereas the threaded fastener can provide a more reliable arrest, depending on the intended purpose. The alignment of the two joining parts can be facilitated, when a bayonet catch is employed, by a continuous logo on the two joining parts and/or by providing corresponding orientation bars or patterns on the two joining parts.

FIG. 4A shows the attachment of the joining parts at laces 404 and 494, which can also be one and the same lace 404. As an alternative, however, one of the joining parts can be embodied via its fixing part at an attachment or an arbitrary object to be appended at a lace with the joining part. As is shown in FIG. 4A, the second joining part can also comprise a spring 495 which is disposed between the external cylinder 493 and the fixing part 491 of the second joining part 490, whereby also the external cylinder 493 is axially movable relative to the cylinder 492. The cylinder 492 can be hollow or solid. In FIG. 4A, a provision of the groove 422 in the first joining part 400 and the pin 496 in the second joining part 490 is represented. A reversed arrangement is also provided.

Figure 4B:
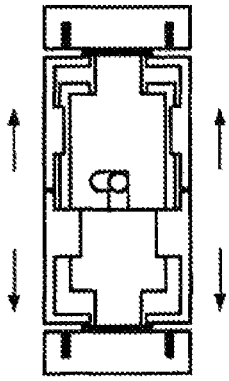
FIG. 4B shows a schematic representation of the joining system of FIG. 4A in a semi-arrested position.

FIG. 4B shows the position of the joining parts 400 and 490 in the joining system after the two joining parts have been connected, such that the two external cylinders have compressed the springs 450 and 495 such that the cylinder 492 has been inserted into the rotary cylinder 420 and the pin 496 is located at the axial stop in the groove 422. As a next step, the rotation 480 would be performed in case of an arrest.

In an alternative design of the joining part according to a preferred embodiment of the invention, the joining part also comprises a fixing part for attaching the joining part at a lace. Here, the connection can be done in a manner transmitting a rotation of the lace about its longitudinal axis to the closing mechanism as well as in a manner that prevents such transmission of force to avoid an unintentional opening of the joining locking. The lace can be fixed at the fixing part by means of terminal knots, screwed joints, the provision of a nut, injection molding processes, or the like. According to this embodiment, a closure support part is provided which is connected with the fixing part. According to a preferred embodiment, this connection can be effected by rotation to avoid in this embodiment a transmission of a rotation of the fixing part about the extension of the longitudinal axis of the lace to the closure support part. In one alternative, the closure support part and the fixing part can be integrally formed or be engaged in such a way that a rotation of the one part is transmitted to the other part. The closure support part is provided with one half of the bayonet catch distal to the fixing part. The bayonet catch can be embodied with corresponding hooks with engagement means, or alternatively from semicircular arcs that can be engaged with the corresponding counterpart of a further joining part. As an alternative to the bayonet catch, a threaded fastener can also be employed. In this alternative embodiment, an external thread is provided at a joining part, while at the joining part to be placed laterally reversed, an internal thread is provided. The provision of a locking by means of a thread is in particular advantageous in such applications where another lace with a joining part is to be connected to a system of a lace with a joining part according to the invention, such that a supporting lace construction is formed, such as with the handle of a handbag, or where the secure attachment of an apparatus provided with a joining part to a lace with a joining part is provided. According to this embodiment, the joining part finally comprises an external cylinder surrounding the closure support part and being axially movable relative to it. Preferably, the external cylinder completely covers the locking elements provided at the closure support part in an end position. In a bayonet catch, the external cylinder would cover the hooks or the arcuate engagement means in this end position at least in a radial plan view. According to an embodiment, the cover is effected aligned with the closure means. Since the external cylinder is axially movable with respect to the closure support part, and the joining part will generally be freely suspended outside the lace guide, this embodiment has the effect that the locking elements are invisible in the normal use of the joining part and cannot get caught by other textile elements or apparatus extensions. Preferably, one half of a bayonet catch is provided as closure means in the form of a semicircle. This embodiment permits a particularly easy placement to a further, laterally reversed joining part and thus permits a particularly easy establishment of the connection with a further joining part with an apparatus and/or lace attached to it. According to an advantageous embodiment, the closure support part is also cylindrical. This embodiment permits a particularly quiet, flush guidance of the closure support part in the external cylinder. However, it is also possible to employ, for example, a half cylinder, a hollow cylinder or a combination of them for saving weight. This alternative embodiment of the joining part can be coupled, in the same manner as described above for the joining part according to FIGS. 3, 4A and 4B, with further joining parts to form a system of two or more joining parts with one or several laces and optionally with an apparatus to be attached.

Figure 5:
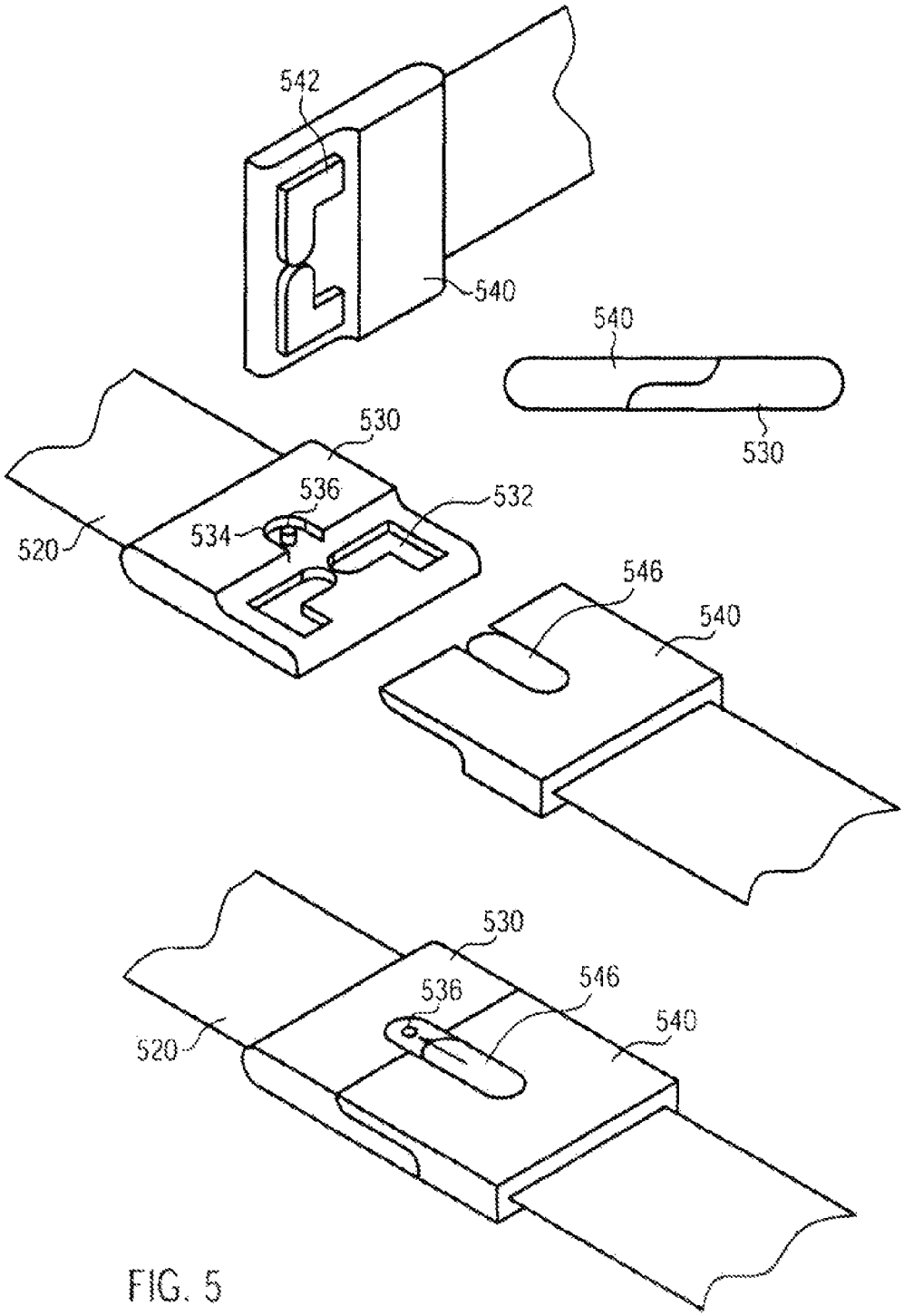
FIG. 5 shows schematic representations concerning an alternative joining system according to the invention.

FIG. 5 shows a further alternative embodiment of the joining parts, in particular suited for a belt lace in the lace systems of FIGS. 1 to 3. The joining part 530 is clamped, glued or hung up at a belt lace 520 in the form of a flat plug part. The joining part 530 comprises recesses 532 and a further recess 534 in which a pin 536 is arranged. The second plug part 540 provided for the joining system comprises pins 542 corresponding to the recesses 532 in the plug part 530. For establishing the locking, the plug part 540 is shifted onto the plug part 530, and a sliding means 546 is shifted in the direction of the plug part 530 and brought into arresting engagement with the pin 536 in the recess 534 for arresting the closure.

Figure 6:
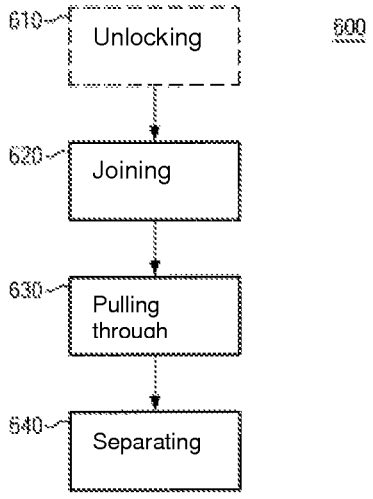
FIG. 6 shows a flow chart for illustrating a method according to the invention for exchanging laces.

FIG. 6 schematically shows in a flow chart steps of a method 600 according to the invention for exchanging a guided lace. The method comprises the joining 620 of a first lace guided in a lace guide with a second lace by joining one joining part each attached to the laces, wherein during the joining process, the joining part of the first lace is situated, together with a proximal, i. e. close end section of the first lace, and a distal, i.e. remote end section of the first lace, outside the lace guide. This is to be understood such that in a loop or clamp lace guide, the two end sections of the lace are outside the last or the first guide means of the lace guide.

In step 630 of pulling through, one pulls at the distal end section of the first lace, so that the laces are guided through the lace guide together with the connected joining parts until the interconnected joining parts exit again from the lace guide. Subsequently, the interconnected joining parts are separated, step 640, so that only the second lace is present in the lace guide and guided through it, and the end sections of the second lace are in turn outside the lace guide.

The joining parts have a diameter that is essentially not larger than the diameter of the first lace or the lace guide, so that laces joined by the joining parts can be pulled through the lace guide together with the connected joining parts. According to an advantageous embodiment, the joining parts have an essentially cylindrical shape. The diameter of the second lace here is oriented by the cross-section of the joining parts. Before the joining step 620, the method can comprise a step 610 of unlocking optionally provided stop devices at the joining part of the first lace to bring the joining part into the above-described preferably cylindrical shape with the required diameter properties and thus permit the passing of the joining part through the lace guide.

The invention claimed is:

1. A lace system which permits to exchange guided laces, comprising:

a device with a lace guide, wherein the device is at least a part of a shoe, a garment, a rucksack or a bag, a first lace guided in the lace guide with a joining part, and a second lace with a joining part, wherein the first and the second laces can be connected via the joining parts and the joining parts have a diameter which is essentially not larger than the diameter of the first lace or the lace guide, such that the laces connected via the joining parts can be pulled through the lace guide together with the connected joining parts, and wherein the first or the second lace comprises an antenna, and a corresponding joining part comprises an antenna port.

2. The lace system according to claim 1, wherein the joining parts have an essentially cylindrical shape.

3. The lace system according to claim 1, wherein the connectable joining parts comprise a threaded fastener or a bayonet catch.

4. The lace system according to claim 1, wherein the first lace comprises one joining part at each of its ends.

5. The lace system according to claim 4, wherein the joining parts of the first lace can be connected.

6. The lace system according to claim 5, wherein the connectable joining parts of the first lace comprise a threaded fastener or a bayonet catch.

7. The lace system according to claim 1, wherein the joining parts are each fixed at one end of a lace.

8. The lace system according to claim 7, wherein the respective fixing comprises clamping, gluing, knotting or hanging up.

9. The lace system according to claim 1, wherein the first and the second laces each comprises a tying lace, a belt lace or a rope.

10. The lace system according to claim 1, wherein the first and/or the second lace is embodied with a joining part at each of its ends, wherein the joining parts and the respective lace are designed such that a media player with a headphone can be connected via the same, so that the media player is joined and connected by means of a corresponding joining part via one of the joining parts, and the headphone is joined and connected by means of a corresponding joining part via the other one of the joining parts.

* * * * *